US011795932B2

(12) United States Patent
Liu et al.

(10) Patent No.: US 11,795,932 B2
(45) Date of Patent: Oct. 24, 2023

(54) DOUBLE-ROLLER HOSE PRESSING APPARATUS FOR PERISTALTIC PUMP

(71) Applicant: HUNAN ZENITHSUN TECHNOLOGY CO., LTD, Hunan (CN)

(72) Inventors: Zhen Liu, Hunan (CN); Bo Yang, Hunan (CN); Haijun Tao, Hunan (CN); Weiquan Cheng, Hunan (CN)

(73) Assignee: HUNAN ZENITHSUN TECHNOLOGY CO., LTD, Hunan (CN)

( * ) Notice: Subject to any disclaimer, the term of this patent is extended or adjusted under 35 U.S.C. 154(b) by 407 days.

(21) Appl. No.: 17/281,261

(22) PCT Filed: Jul. 11, 2019

(86) PCT No.: PCT/CN2019/095577
§ 371 (c)(1),
(2) Date: Mar. 30, 2021

(87) PCT Pub. No.: WO2020/063032
PCT Pub. Date: Apr. 2, 2020

(65) Prior Publication Data

US 2022/0003226 A1 Jan. 6, 2022

(30) Foreign Application Priority Data

Sep. 30, 2018 (CN) ..... 201821612496.8

(51) Int. Cl.
*F04B 43/12* (2006.01)
*F04B 53/00* (2006.01)

(52) U.S. Cl.
CPC ..... *F04B 43/1276* (2013.01); *F04B 43/1215* (2013.01); *F04B 53/006* (2013.01)

(58) Field of Classification Search
CPC ..... F04B 43/1215; F04B 43/1276; F04B 53/006; F04B 43/12; F04B 43/1253; F04B 45/00; F04B 45/06; F04B 45/065
(Continued)

(56) References Cited

U.S. PATENT DOCUMENTS 2,890,855 A * 6/1959 Little ..... F16K 7/06 251/5
3,408,034 A * 10/1968 Lau ..... F16K 7/045 269/157

(Continued)

FOREIGN PATENT DOCUMENTS

CN 201696263 1/2011
CN 205001158 1/2016

(Continued)

OTHER PUBLICATIONS

Machine Translation of DE 577819 C to Hemmerdinger, retrieved from espacent on Jun. 20, 2023 (Year: 2023).*

(Continued)

*Primary Examiner* — Philip E Stimpert
*Assistant Examiner* — Dnyanesh G Kasture
(74) *Attorney, Agent, or Firm* — JCIP GLOBAL INC.

(57) ABSTRACT

A double-roller hose pressing apparatus for a peristaltic pump is provided. Two sides of a working hose (3) in the peristaltic pump are respectively provided with a set of flexible-rolling rollers (2) configured for pressing hose, and the two sets of rollers (2) are arranged in relative positions to clamp the working hose (3) during operation.

6 Claims, 8 Drawing Sheets

(58) Field of Classification Search
USPC ..... 251/6, 9; 417/477.1, 477.13, 418, 481, 417/488
See application file for complete search history.

(56) References Cited

U.S. PATENT DOCUMENTS

| | | | | | |
|---|---|---|---|---|---|
| 4,403,764 | A * | 9/1983 | Repplinger | ..... | F16K 7/06 251/5 |
| 4,856,972 | A * | 8/1989 | Van Benschoten | ..... | F04B 43/12 604/153 |
| 10,273,950 | B2 * | 4/2019 | Buckberry | ..... | F04B 43/1261 |
| 2004/0191086 | A1 * | 9/2004 | Paukovits, Jr. | ..... | F04B 43/1269 417/313 |

FOREIGN PATENT DOCUMENTS

| | | | | | |
|---|---|---|---|---|---|
| CN | 209083527 | | 7/2019 | | |
| DE | 577819 | C * | 6/1933 | ..... | F04B 43/1215 |
| JP | S5818584 | | 2/1983 | | |
| JP | 2006118456 | | 5/2006 | | |

OTHER PUBLICATIONS

"International Search Report (Form PCT/ISA/210) of PCT/CN2019/095577," dated Sep. 29, 2019, with English translation thereof, pp. 1-4.

* cited by examiner

DOUBLE-ROLLER HOSE PRESSING APPARATUS FOR PERISTALTIC PUMP

CROSS-REFERENCE TO RELATED APPLICATION

This application is a 371 of international application of PCT application serial no. PCT/CN2019/095577, filed on Jul. 11, 2019, which claims the priority benefit of China application no. 201821612496.8, filed on Sep. 30, 2018. The entirety of each of the above mentioned patent applications is hereby incorporated by reference herein and made a part of this specification.

BACKGROUND

Technical Field

The present invention mainly relates to the technical field of peristaltic pumps, in particular to a double-roller hose pressing apparatus for peristaltic pump.

Description of Related Art

The peristaltic pumps of prior art involve rotary peristaltic pumps and linear peristaltic pumps. Both of the peristaltic pumps share a common feature, that is, one side of a working hose 3 is provided with a flexible rolling roller 2, and the other side of the working hose 3 is provided with a relatively fixed back plate 1, and the working hose 3 is pressed against the back plate 1 by the flexible rolling roller 2, thereby achieving the purpose of peristaltic fluid transmission, as shown in FIG. 1 and FIG. 2.

Two major technical problems exist in the prior art of hose pressing by the fixed side and the movable roller 2 on the other side, first one is that an inner wall of the working hose 3 is easily worn out, and second one is that removal of the fixed back plate 1 necessary for hose replacement is inconvenient. It is easy to understand the problem that the fixed back plate 1 requires to be removed to replace the hose. That is, the pump cover should be opened before replacing the hose in the peristaltic pump of prior art.

The hose pressing of prior art accelerates the wear course of the inner wall of hose. Referring to FIG. 3, taking the linear peristaltic pump for example, the causes of wear in prior art are analyzed as follows. The hose pressing operation of the peristaltic pump is divided into four processes marked as four states, respectively. One side of the working hose 3 close to the fixed back plate 1 is called a side A, and the other side of the working hose 3 close to the roller 2 is called a side B.

State (a) is an initial state, in which the working hose 3 is in a natural state and free from a pressure or a tensile force of the roller 2. Suppose that a radius of the roller 2 is R and a wall thickness of the working hose 3 is t.

State (b) is a critical state, in which the side A just contacts the side B upon a compression of the working hose 3 by the roller 2. In this state, the side A and the side B are in a critical contact position and no force is generated therebetween; the wall thickness t at the side A of the working hose 3 remains unchanged. Since the side B of the working hose 3 is stretched under compression from the roller 2 at the contact position, suppose that a wall thickness of the side B of the working hose 3 at the contact position with the roller 2 is t1, and an arc radius at the contact position between the side B of the working hose 3 and the roller 2 is R1. According to tensile property of the object, it can be concluded that the wall thickness of the side B of the working hose 3 at the contact position with the roller 2 decreases, i.e., t>t1, and R1=R+t1.

In state (c), the roller 2 presses tightly against the working hose 3. Since the fluid in the working hose 3 is pressurized during the pumping process, the side A should be in fully contact with the side B during the operation to maintain a certain pressing force, thereby pumping the fluid stably. In this state, an action-reaction force pair exists between the side A and the side B, and the action forces exerted on the side A and the side B are provided by an elastic deformation of the working hose 3. In that case, therefore, side A and side B have the same wall thickness at the contact position. Suppose that the wall thickness of the contact parts between the side A and the side B of the working hose 3 is t2, a chord length of the contact part is L, an angle corresponding to the chord length is a, and an arc radius of the contact parts is R2. According to force analysis, it is easy to conclude that t>t1>t2, and R2=R+t2, thus R1>R2.

In State (d), the roller 2 presses tightly against the working hose 3 and rolls forward for a certain distance, there must be a state in which the wall thickness of the side B of the hose is reset to t1 and the arc radius to R1, which is supposed to be the state (d).

Further qualitative analysis is done according to the above-described states.

In the process from the state (a) to the state (b), since there is no contact between the side A and side B, there is no friction or wear between the side A and the side B.

In the process from the state (b) to the state (c), since R1>R2, indicating that an arc length of the inner wall at the side B decreases, and the linear chord length L at the side A is changed to an arc length under compression, thus the arc length of the inner wall of the side A increases, and an extension of the side A and an contraction of the side B are completed in the contact process. Therefore, relative motion exists between the side A and the side B, which is prone to wear.

On the contrary, in the process from the state (c) to the state (d), the arc length of the inner wall of the side B increases, and that of the side A restores and decreases. Similarly, the contraction of the side A and the extension of the side B are completed in the contact process. Therefore, the relative motion exists between the side A and the side B, which is prone to wear.

Likewise, the rotary peristaltic pumps also have the wear-out problem. The wear problem caused by relative motion exists in case of the pump body rotating diameter larger than the roller 2's diameter, and the more the diameter difference and the relative motion is, the more the wear is prone to be.

SUMMARY

The technical problem to be solved by the present invention is to provide a double-roller hose pressing apparatus for peristaltic pump, which has simple structure, convenient operation and effective hose wear reduction to solve the technical problems of prior art.

To solve the above-described technical problem, the present invention adopts the following technical solution.

A double-roller hose pressing apparatus for peristaltic pump includes two flexible-rolling rollers respectively disposed at two sides of a working hose in a peristaltic pump. The rollers are configured for pressing hose, and the two rollers are arranged in relative positions to clamp the working hose during operation.

As a further improvement of the present invention, one of the two rollers configured for pressing hose is a fixed hose-pressing roller assembly, and the other one of the rollers is a movable hose-pressing roller assembly.

As a further improvement of the present invention, the movable hose-pressing roller assembly comprises one driving assembly. The driving assembly comprises a driving device and a mounting base body; and the driving device drives the rollers to move in parallel to make the two rollers arranged in relative positions in a clamping state or a loosening state.

As a further improvement of the present invention, the two rollers configured for pressing hose are both movable hose-pressing roller assemblies, and the two movable hose-pressing roller assemblies clamp the working hose by synchronized swinging motion towards each other.

As a further improvement of the present invention, each of the movable hose-pressing roller assemblies comprises a roller component, an eccentric crankshaft, a synchronizing gear, a driven spiral gear and a driving spiral gear. The roller component is arranged at one end of the eccentric crankshaft. The driven spiral gear and the synchronizing gear are arranged on the eccentric crankshaft. The eccentric crankshaft swings by coordination between the driving spiral gear and the driven spiral gear; and the roller components of the two movable hose-pressing roller assemblies rotate synchronously by the synchronizing gear.

As a further improvement of the present invention, the two rollers configured for pressing hose are both movable hose-pressing roller assemblies, and the two movable hose-pressing roller assemblies clamp the working hose by synchronized swinging motion pulled through connecting rods.

As a further improvement of the present invention, each of the movable hose-pressing roller assemblies comprises a swing connecting rod, a roller component and an eccentric crankshaft. A middle part of the eccentric crankshaft is connected with a driving swing rod located between the two movable hose-pressing roller assemblies through a driven swing rod. The driven swing rod and the eccentric crankshaft are driven to swing synchronously by an action of the driving swing rod, such that the roller component on the eccentric crankshaft clamps the working hose.

As a further improvement of the present invention, the roller component is arranged on the eccentric crankshaft by a roller bearing, and the eccentric crankshaft is arranged on the mounting base body by a crankshaft bearing.

As a further improvement of the present invention, each of the movable hose-pressing roller assemblies comprises a driving assembly, and the driving assembly is driven in pneumatic, electric or hydraulic mode.

Compared with the prior art, the present invention has the advantages as follows. The double-roller hose pressing apparatus for peristaltic pump of the present invention is simple in structure and convenient to use. The flexible rolling rollers used for pressing hose are symmetrically arranged on two sides of the hose, the two rollers are equal in diameter, and the fixed back plate of prior art is replaced by the roller arranged on one side. The changes in the wall thickness and radius at the side A of the hose are completely synchronous and identical to that of the side B during the hose pressing process by the rollers, thus avoid relative motion between the side A and the side B, thereby significantly decreasing the inner wall wear of the hose. Meanwhile, as the roller on one side replaces the fixed back plate of prior art, the hose replacement is available by opening the movable roller without removing the fixed back plate, thereby simplifying and facilitating the operation.

DESCRIPTION OF THE EMBODIMENTS

The present invention will be further described in detail in combination with accompanying drawings and embodiments.

Figure 1:
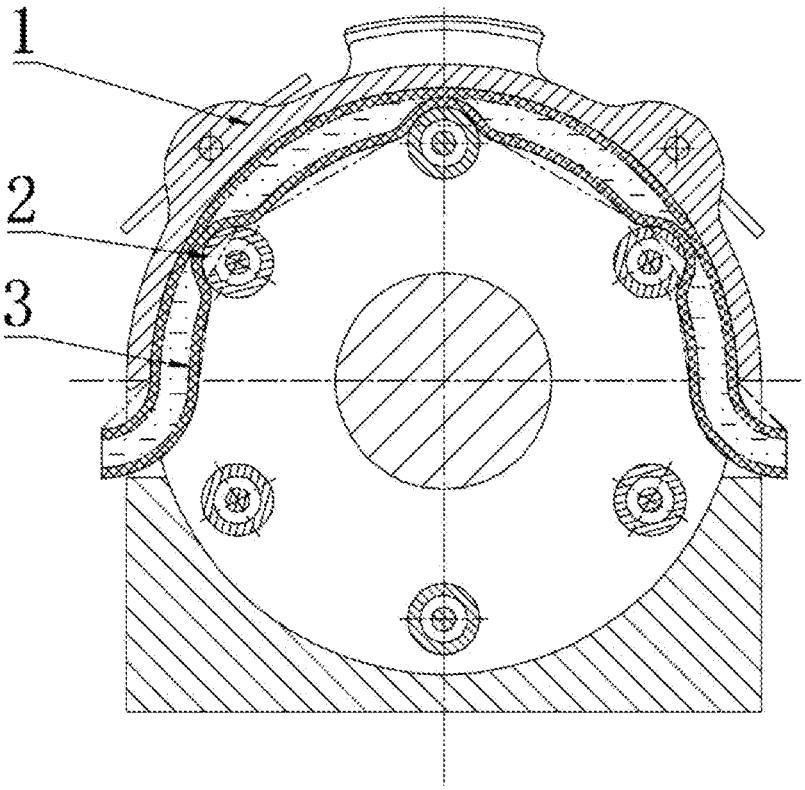
FIG. 1(Prior Art)
FIG. 1 is a structural diagram of a hose-pressing structure of a rotary peristaltic pump of prior art.
Figure 2:
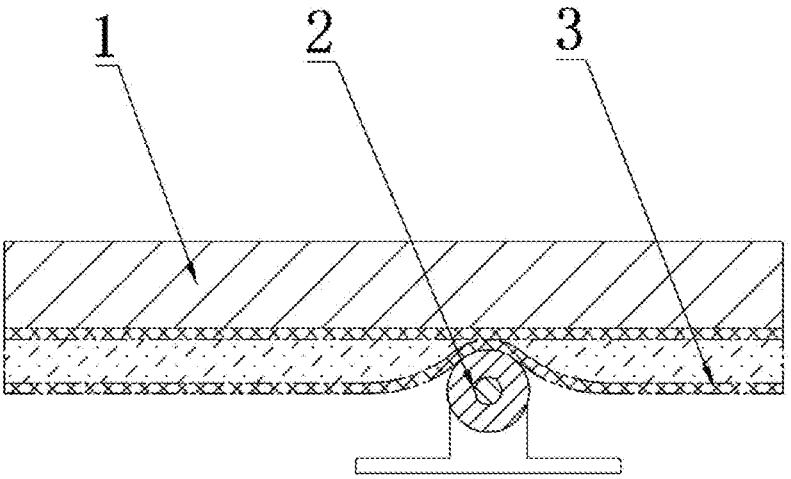
FIG. 2(Prior Art)
FIG. 2 is a structural diagram of a hose-pressing structure of a linear peristaltic pump of prior art.
Figure 3:
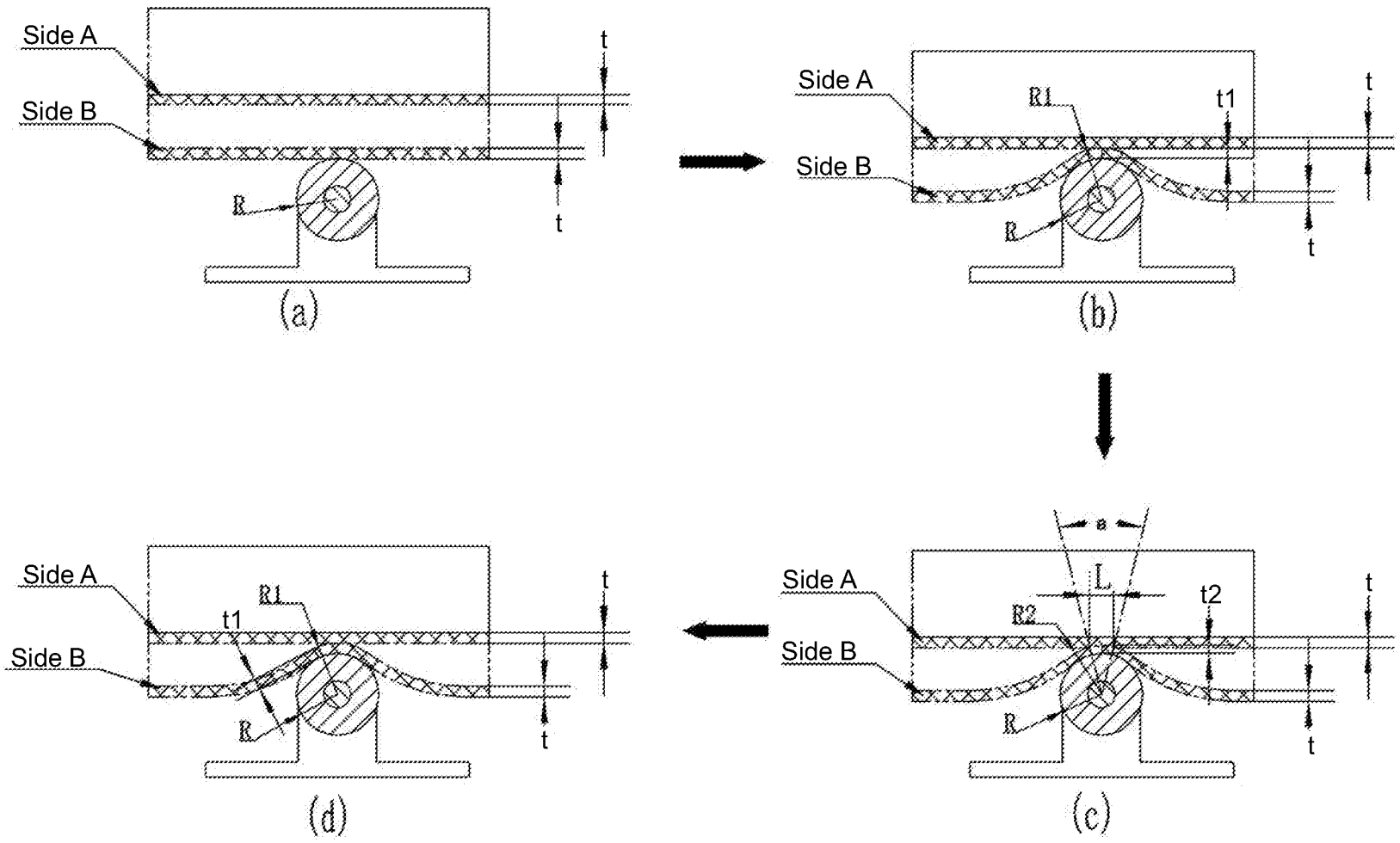
FIG. 3(Prior Art)
FIG. 3 is a schematic diagram for analyzing working states of the hose pressing of prior art.
Figure 4:
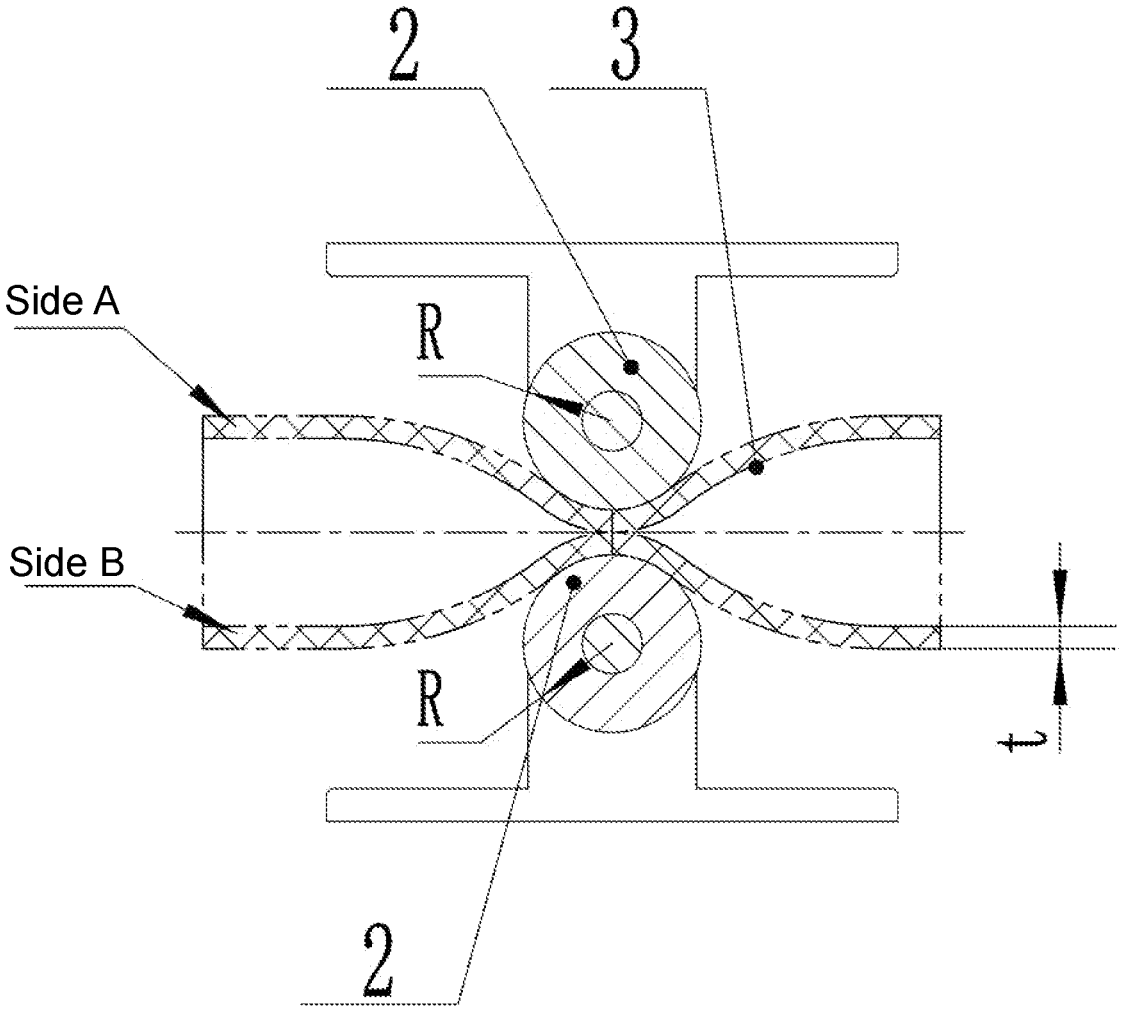
FIG. 4 is a schematic diagram of the present invention.
Figure 5:
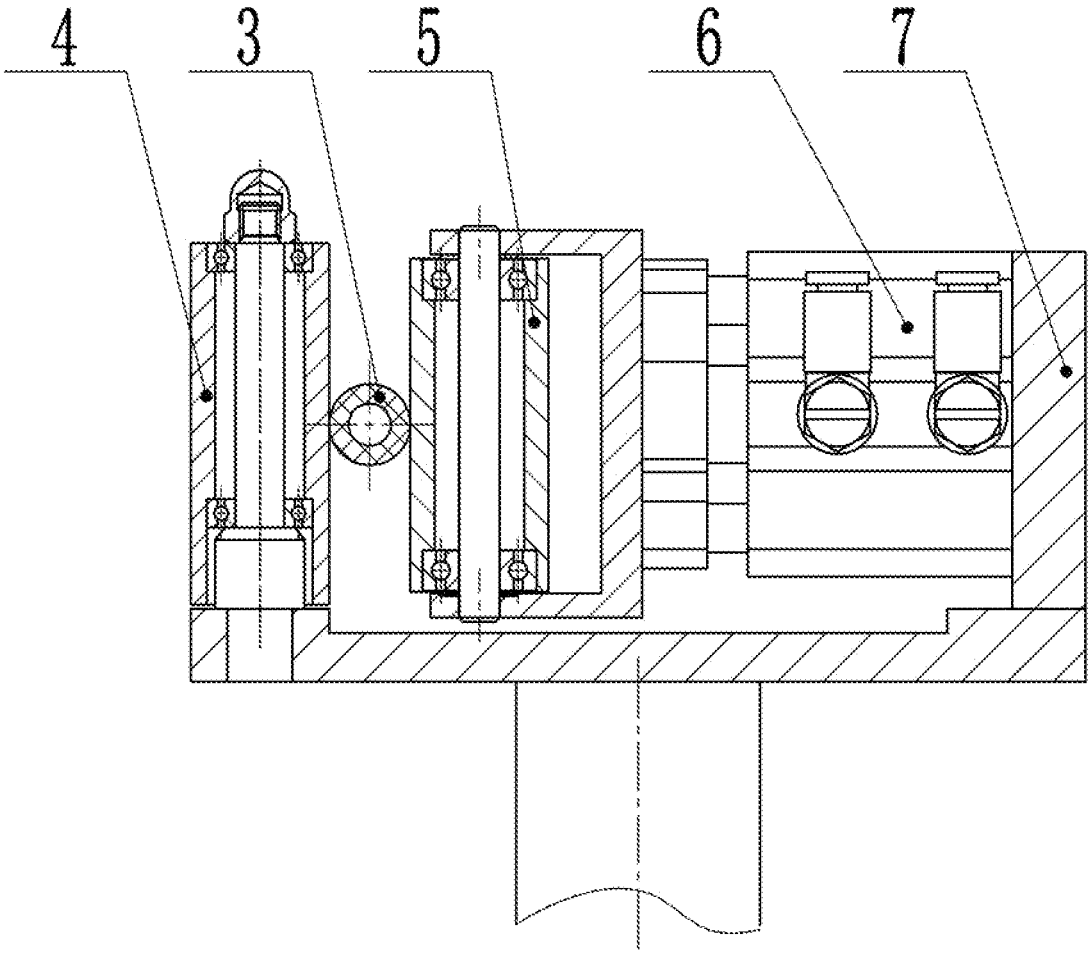
FIG. 5 is a structural diagram of embodiment 1 of the present invention.

Embodiment 1. Referring to FIG. 4 and FIG. 5, a double-roller hose pressing apparatus for peristaltic pump is disclosed. Flexible-rolling rollers 2 used for pressing hose are symmetrically arranged on two sides of a working hose 3, the two rollers 2 used for pressing hose are equal in diameter, and the design of fixed back plate 1 of prior art is replaced by the roller 2 used for pressing hose arranged on one side. Referring to FIG. 5, the changes in the wall thickness and radius at the side A of the working hose 3 are completely synchronous and identical to that of the side B during the hose pressing process by the rollers 2, thus avoid relative motion between the side A and the side B, thereby significantly decreasing the inner wall wear of the working hose 3. Meanwhile, as the roller 2 on one side replaces the fixed back plate 1 of prior art, replacement of the working hose 3 is available by opening the movable roller 2 without removing the fixed back plate 1, thereby simplifying and facilitating the operation.

In the present embodiment, one of the two rollers 2 arranged in relative positions is a fixed hose-pressing roller assembly 4, and the other one of the two rollers 2 is a movable hose-pressing roller assembly 5, i.e., the roller 2 at one side is in a fixed state by means of the fixed hose-pressing roller assembly 4. The movable hose-pressing roller assembly 5 comprises one driving assembly. The driving assembly comprises a driving device 6 and a mounting base body 7. The driving device 6 drives the rollers 2 to move in parallel to make the two rollers 2 arranged in relative positions in a clamping state or a loosening state. The driving device 6 is driven in pneumatic, electrical or hydraulic mode, based on actual requirements.

Figure 6:
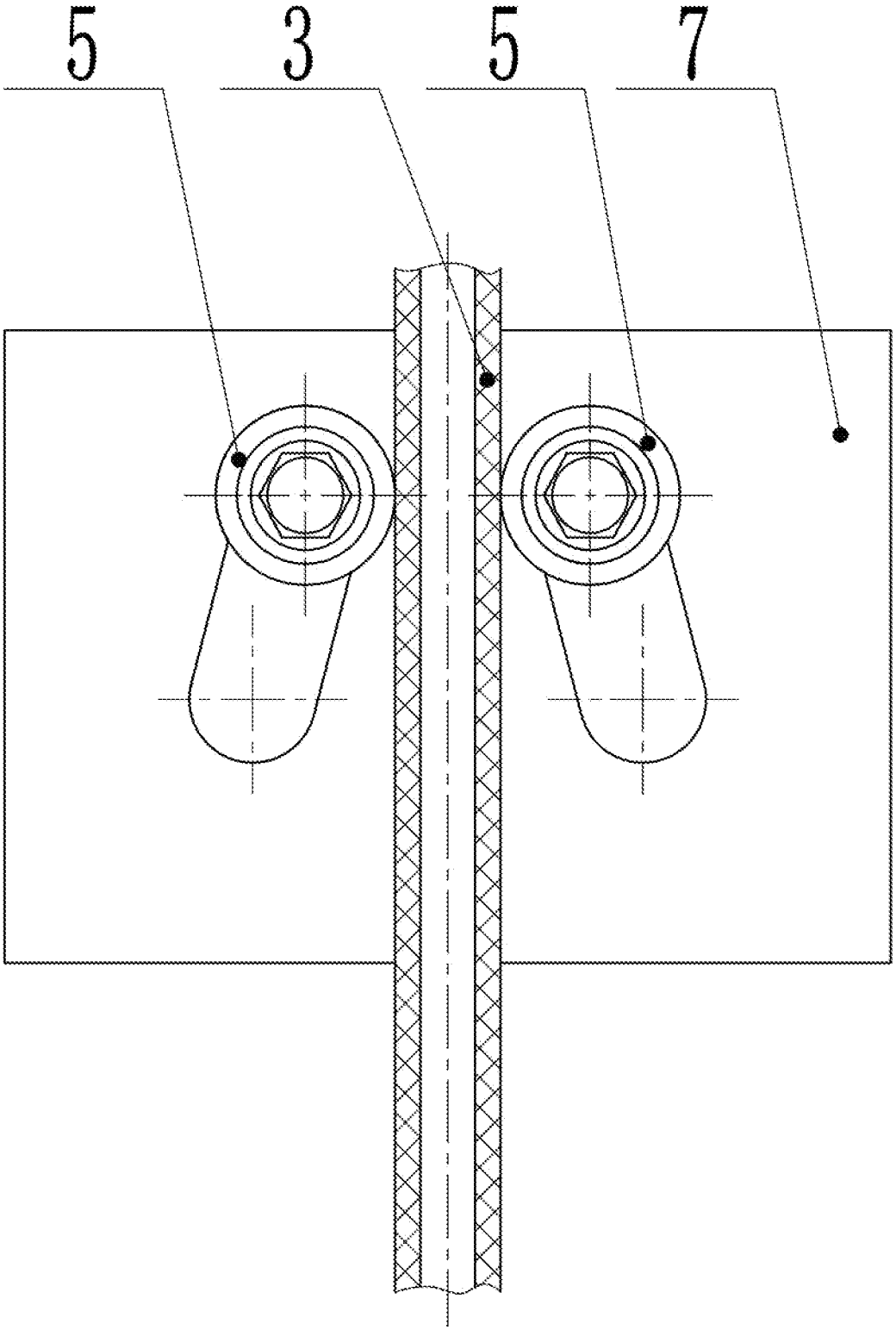
FIG. 6 is a structural diagram of embodiment 2 of the present invention.
Figure 7:
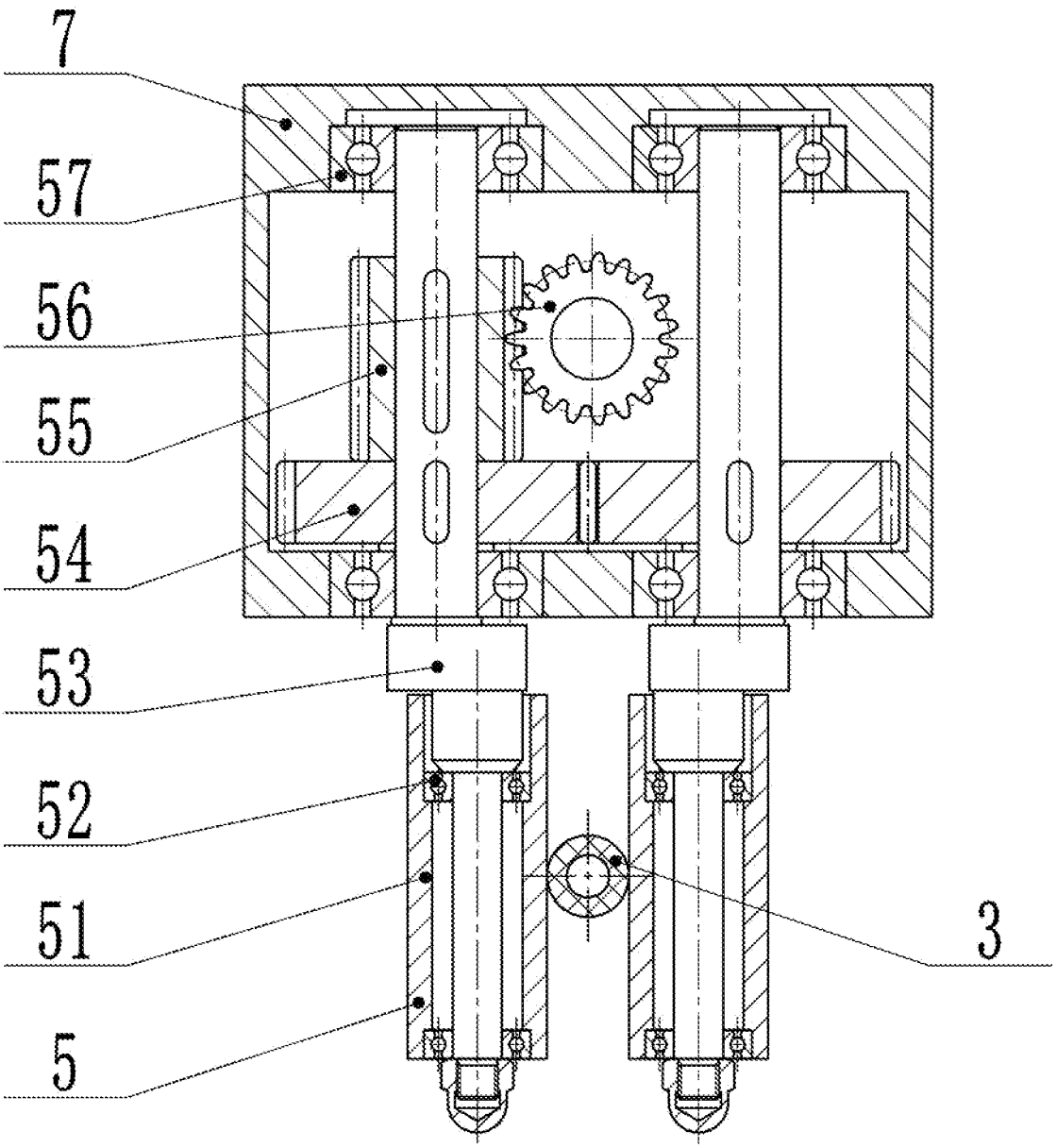
FIG. 7 is a top view of FIG. 6.

Embodiment 2. Referring to FIG. 4, FIG. 6 and FIG. 7, the difference between this embodiment and embodiment 1 lies in that the rollers 2 arranged in relative positions are both movable hose-pressing roller assemblies 5, and the two movable hose-pressing roller assemblies 5 clamp the working hose 3 by means of synchronized swinging motion towards each other.

In the present embodiment, each of the movable hose-pressing roller assemblies 5 comprises a roller component 51, an eccentric crankshaft 53, a synchronizing gear 54, a driven spiral gear 55 and a driving spiral gear 56. The roller component 51 is arranged on the eccentric crankshaft 53 by means of a roller bearing 52. The eccentric crankshaft 53 is arranged on the mounting base body 7 by means of a crankshaft bearing 57. The roller component 51 is arranged at one end of the eccentric crankshaft 53. The driven spiral gear 55 and the synchronizing gear 54 are arranged on the eccentric crankshaft 53. The eccentric crankshaft 53 swings by coordination between the driving spiral gear 56 and the driven spiral gear 55, and the roller components 51 of the two movable hose-pressing roller assemblies 5 rotate synchronously by means of the synchronizing gear 54.

It should be appreciated that the above-described movable hose-pressing roller assemblies 5 respectively comprise a driving assembly, and the driving assembly is driven in pneumatic, electrical or hydraulic mode, based on actual requirements.

Figure 8:
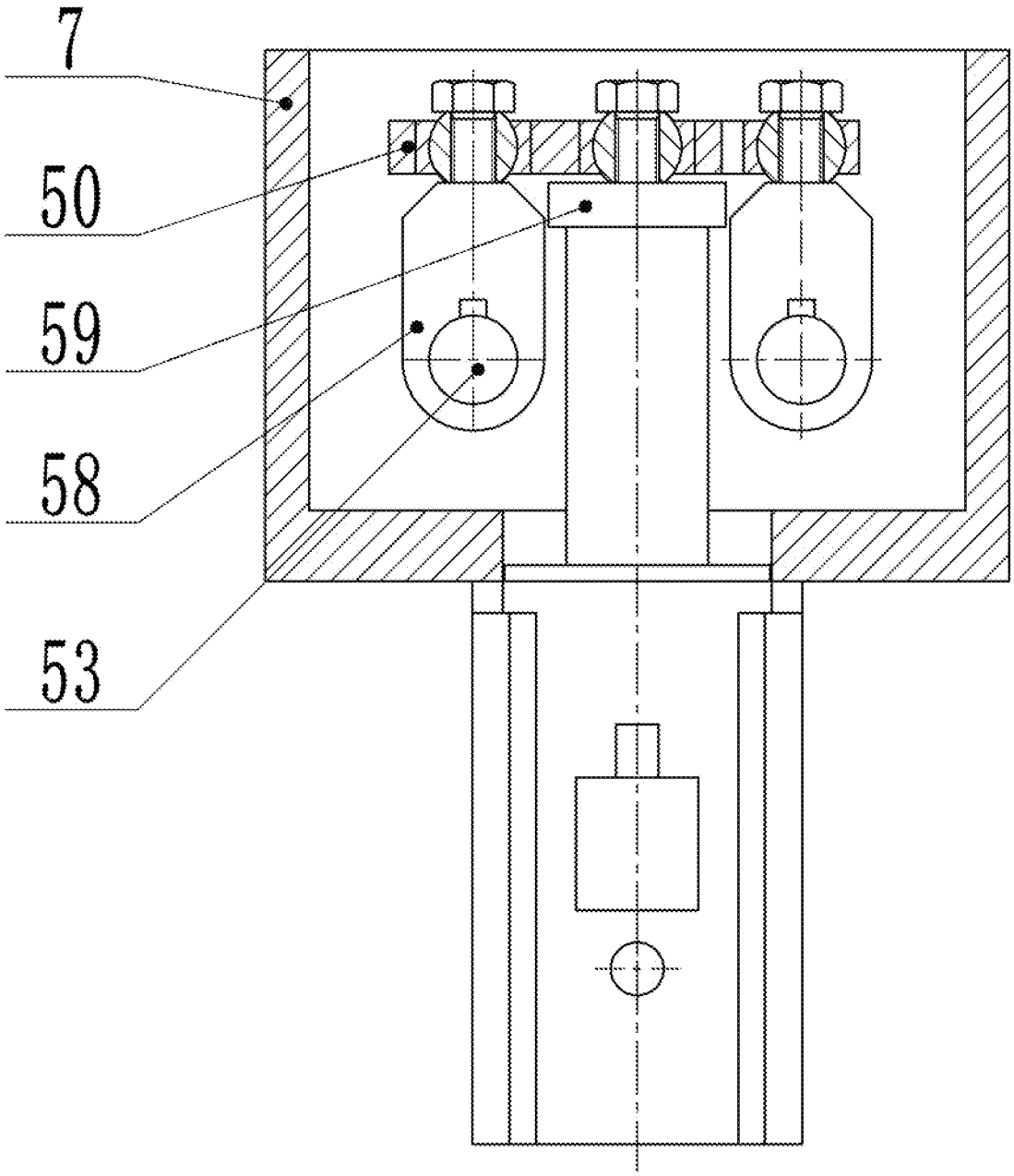
FIG. 8 is a structural diagram of embodiment 3 of the present utility model invention.
Figure 9:
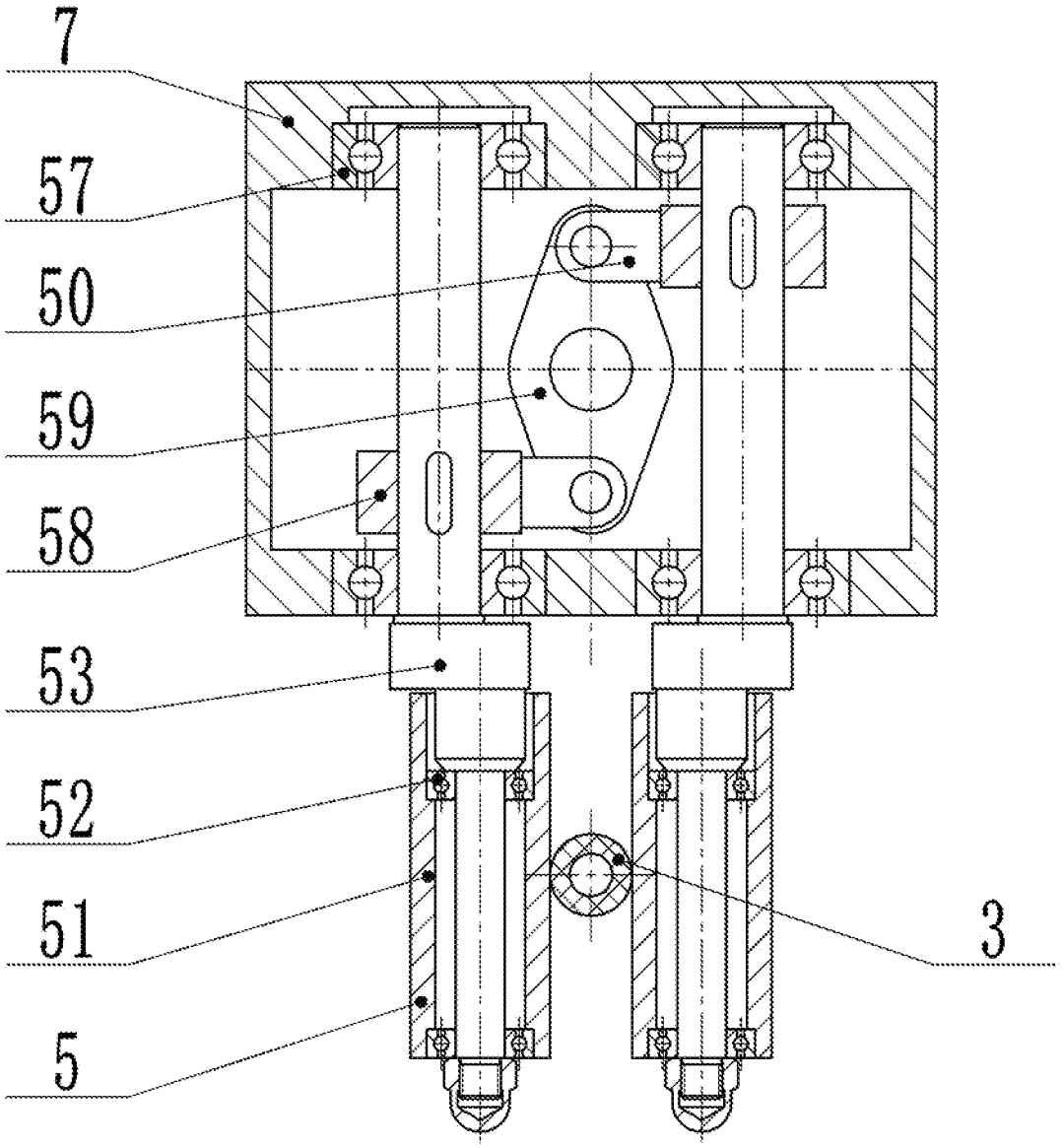
FIG. 9 is a top view of FIG. 8.

Embodiment 3. Referring to FIG. 4, FIG. 8 and FIG. 9, the difference between this embodiment and the embodiment 1 lies in that the rollers 2 arranged in relative positions are both the movable hose-pressing roller assembly 5, and the two movable hose-pressing roller assemblies 5 clamp the working hose 3 by means of synchronized swinging motion of the rollers 2 pulled through connecting rods.

In the present embodiment, each of the movable hose-pressing roller assemblies 5 comprises a swing connecting rod 50, the roller component 51 and the eccentric crankshaft 53. The roller component 51 is arranged on the eccentric crankshaft 53 by means of the roller bearing 52. The eccentric crankshaft 53 is arranged on the mounting base body 7 by means of the crankshaft bearing 57. The roller component 51 is arranged at one end of the eccentric crankshaft 53. A middle part of the eccentric crankshaft 53 is connected with a driving swing rod 59 located between the two sets of movable hose-pressing roller assemblies 5 through a driven swing rod 58. The driven swing rod 58 and the eccentric crankshaft 53 are driven to swing synchronously by an action of the driving swing rod 59, such that the roller component 51 on the eccentric crankshaft 53 clamps the working hose 3.

It should be appreciated that the above-described movable hose-pressing roller assemblies 5 respectively comprise a driving assembly, and the driving assembly is driven in pneumatic, electrical or hydraulic mode, based on actual requirements.

The above are only preferred embodiments of the present invention, and the protection scope of the present invention is not limited to the embodiments described above. The technical solutions under the ideas of the present invention fall into the protection scope of the present invention. It should be pointed out that, for those ordinary skilled in the art, some improvements and modifications without departing from the principle of the present invention shall be deemed to fall into the protection scope of the present invention.

What is claimed is:

1. A double-roller hose pressing apparatus for a peristaltic pump, —comprising two flexible-rolling rollers respectively disposed at two sides of a working hose in the peristaltic pump, wherein the two rollers are configured for pressing a working hose, and the two rollers are arranged in relative positions to clamp the working hose during operation, wherein the two rollers configured for pressing the working hose are both movable hose-pressing roller assemblies, and the two movable hose-pressing roller assemblies clamp the working hose by synchronized swinging motion towards each other, wherein each of the movable hose-pressing roller assemblies comprises a roller component, an eccentric crankshaft, a synchronizing gear, a driven spiral gear and a driving spiral gear; each roller component is arranged at one end of its respective eccentric crankshaft each driven spiral gear and synchronizing gear are arranged on their respective eccentric crankshaft each eccentric crankshaft swings by coordination between its driving spiral gear and driven spiral gear; and the roller components of the two movable hose-pressing roller assemblies rotate synchronously by the synchronizing gears.

2. The double-roller hose pressing apparatus for the peristaltic pump as recited in claim 1, wherein each roller component is arranged on its respective eccentric crankshaft by a respective roller bearing, and each eccentric crankshaft is arranged on a mounting base body by a respective crankshaft bearing.

3. The double-roller hose pressing apparatus for the peristaltic pump as recited in claim 1, wherein each of the movable hose-pressing roller assemblies comprises a respective driving assembly, and the driving assemblies are driven in pneumatic, electric or hydraulic mode.

4. A double-roller hose pressing apparatus for a peristaltic pump, comprising two flexible-rolling rollers respectively disposed at two sides of a working hose in the peristaltic pump, wherein the two rollers are configured for pressing a working hose, and the two rollers are arranged in relative positions to clamp the working hose during operation, wherein the two rollers configured for pressing the working hose are both movable hose-pressing roller assemblies, and the two movable hose-pressing roller assemblies clamp the working hose by synchronized swinging motion caused by pulling connecting rods, wherein each of the movable hose-pressing roller assemblies comprises a swing connecting rod, a roller component and an eccentric crankshaft a middle part of each eccentric crankshaft is connected through a respective driven swing rod to a driving swing rod located between the two movable hose-pressing roller assemblies, and the driven swing rods and the eccentric crankshafts are driven to swing synchronously by an action of the driving swing rod, such that each roller component on its respective eccentric crankshaft clamps the working hose.

5. The double-roller hose pressing apparatus for the peristaltic pump as recited in claim 4, wherein each roller component is arranged on its respective eccentric crankshaft by a respective roller bearing, and each eccentric crankshaft is arranged on a mounting base body by a respective crankshaft bearing.

6. The double-roller hose pressing apparatus for the peristaltic pump as recited in claim 4, wherein each of the movable hose-pressing roller assemblies comprises a respective driving assembly, and the driving assemblies are driven in pneumatic, electric or hydraulic mode.

* * * * *